United States Patent [19]

Kuno et al.

[11] Patent Number: 4,646,044

[45] Date of Patent: Feb. 24, 1987

[54] BOBBINLESS SOLENOID COIL

[75] Inventors: Kazuo Kuno; Masahiro Kinugasa, both of Kobe, Japan

[73] Assignee: Mitsubishi Denki Kabushiki Kaisha, Tokyo, Japan

[21] Appl. No.: 712,484

[22] Filed: Mar. 18, 1985

[30] Foreign Application Priority Data

Mar. 19, 1984 [JP] Japan ..... 59-51126

[51] Int. Cl.[4] ..... H01F 5/00

[52] U.S. Cl. ..... 335/299; 335/216; 29/605

[58] Field of Search ..... 335/216, 282, 299, 278; 324/318; 29/605

[56] References Cited

U.S. PATENT DOCUMENTS 3,158,793 11/1964 Swartz ..... 335/216

3,613,006 10/1971 Kantrowitz ..... 335/216

4,066,991 1/1978 Marstoxi et al. ..... 335/216

*Primary Examiner*—George Harris

*Attorney, Agent, or Firm*—Sughrue, Mion, Zinn, Macpeak and Seas

[57] ABSTRACT

A large diameter, high current capacity, superconductive solenoid coil is formed by winding a conductor around a cylindrical mandrel 2, and then encasing the outer surface of the coil 1 with a support cylinder comprising an assembly of cylinder sectors 11 rigidly joined together along axial seam lines. The joining of the sectors may be implemented by welding, and heat shielding strips 13 may be disposed in recesses 15 in the sectors to prevent thermal damage to the coil insulation 14 during the welding. The support cylinder serves to absorb heat generated during the operation of the coil, and to withstand the outwardly directed electromagnetic forces developed. The mandrel is removed after the cylinder sectors are joined.

8 Claims, 7 Drawing Figures

FIG. 1
PRIOR ART
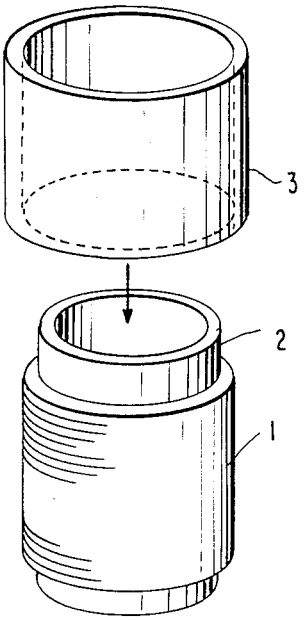
FIG. 2
PRIOR ART
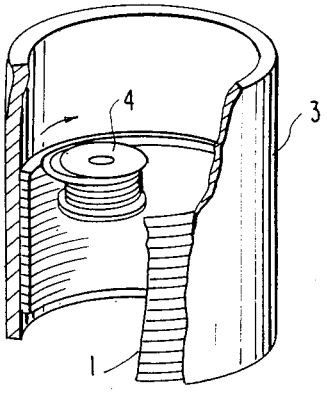
FIG. 3
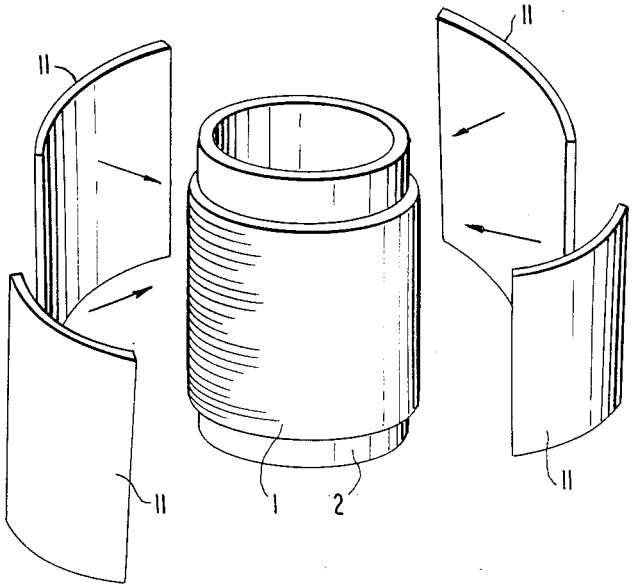
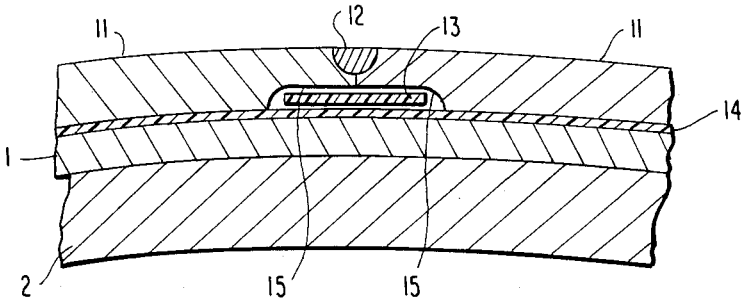
FIG. 4

FIG. 5
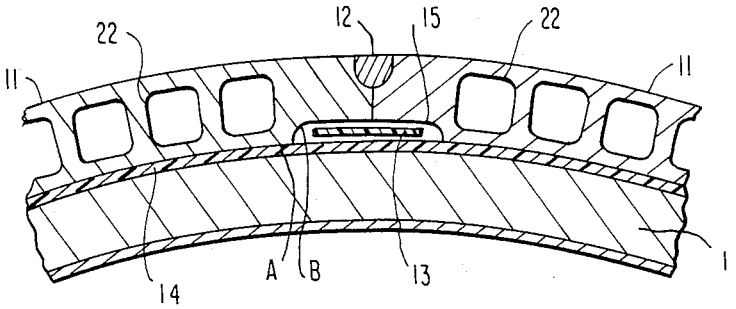
FIG. 6
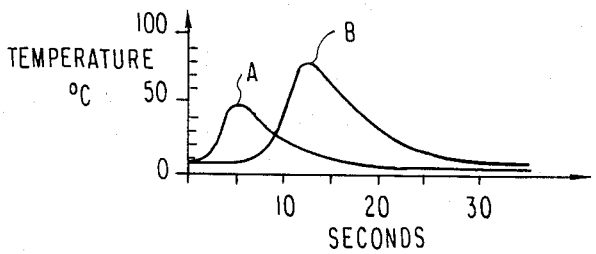
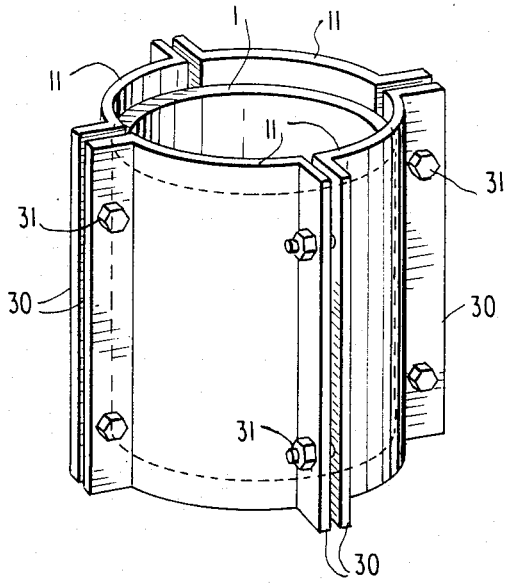
FIG. 7

BOBBINLESS SOLENOID COIL

BACKGROUND OF THE INVENTION

This invention relates to a bobbinless solenoid coil and to a method for manufacturing such a coil, particularly a large superconducting solenoid for use in nuclear fusion devices and having a diameter on the order of 3 meters.

In very large and specialized coils of this type it is desirable if not essential to avoid the use of a permanent inner bobbin in order to minimize the material thickness of the solenoid, and the exterior of the coil must be supported by a rigid cylindrical casing in order to withstand the extremely high, outwardly directed electromagnetic forces generated during the use of the solenoid. The current carried by the coil windings is on the order of 3,000–5,000 amperes. The dimensional tolerances of the coils are very precise and critical, and both a tight and uniform contact must be established between the outer surface of the coil and the surrounding support cylinder to implement the necessary structural support and to enable effective cooling in view of the very large quantities of heat generated by the current flowing through the coil. All of these constraints present very specialized and difficult manufacturing problems as contrasted with small and conventional solenoid coils which can be wound on permanent inner bobbins in a fully automated manner and which can easily and inherently withstand the relatively low magnitude electromagnetic forces developed during operation without resort to any external support cylinder.

One prior art approach to the fabrication of these large and specialized solenoid coils is illustrated in FIG. 1 and described in greater detail in volume 45 of the Journal de Physique of January 1984 on pages 333–336. Essentially, a coil 1 is wound around an inner mandrel 2, an outer support cylinder 3 is heated to enlarge its inner diameter, is inserted over the coil 1, and is thereafter allowed to cool to effect a shrink fit. The mandrel 2 is then disassembled and removed. With such a fabrication technique the degree of shrinkage of the cooling support cylinder is somewhat unpredictable and difficult to control, however, which leads to inaccuracies and excessive rejects. Too little shrinkage results in poor and non-uniform contact between the cylinder and the coil; too much shrinkage results in the deformation of the coil windings.

A further prior art technique for the fabrication of these superconducting solenoids is generally illustrated in FIG. 2 and described in greater detail on pages 337–340 of the aforementioned Journal de Physique volume. In this technique the insulated conductor is first wound about a temporary or dummy mandrel 4. The latter is then disposed inside the support cylinder 3 and the conductor is applied against the inner surface of the cylinder under compressive stress to thereby form the coil 1. With this procedure it is difficult to accurately control the axial or compressive stress applied to the conductor during the "transfer" winding, however, which leads to non-uniform contact adhesion between the coil 1 and the cylinder 3. Too much stress leads to the buckling of the conductor; too little stress results in contact gaps and discontinuities.

SUMMARY OF THE INVENTION

The present invention avoids the drawbacks and disadvantages of the prior art as discussed above by dividing the support cylinder into a plurality of quadrant or sector members. The insulated conductor is wound around a central core or mandrel to thereby accurately control the internal dimensions and configuration of the coil, whereafter the support cylinder sectors are assembled around the outer circumference of the coil and rigidly joined together along their abutting surfaces by welding or the like. Before the cylinder seams are welded the sectors may be compressed against the coil windings to a precisely controlled degree by exterior clamping rings. Internal recesses may also be provided in the interior abutting surfaces of the support cylinder sectors to accommodate heat shielding strips to thereby protect the conductor insulation proximate the seams from thermal damage during the welding.

BRIEF DESCRIPTION OF THE DRAWINGS

FIG. 1 is a perspective view showing a first prior art technique for manufacturing a large dimensioned bobbinless coil, FIG. 2 is a perspective view showing a second prior art technique for manufacturing such a coil, FIG. 3 is a perspective view illustrating a method of manufacturing a large dimensioned bobbinless coil in accordance with the present invention, FIG. 4 is a part sectional view of the assembled coil of FIG. 3 illustrating a weld seam and associated heat shield, FIG. 5 is a part sectional view similar to FIG. 4 illustrating a modification wherein means are provided for cooling the weld seam zone, FIG. 6 is a plot of time v. temperature curves at points proximate a sector seam during welding, and FIG. 7 is a perspective view of an alternate construction wherein the support cylinder sectors are bolted together.

DETAILED DESCRIPTION OF THE PREFERRED EMBODIMENTS

Referring to FIG. 3, in accordance with the present invention the outer support cylinder for the solenoid coil is formed of, in this example, four separate quadrants or sectors 11 which are radially applied against and around the outer circumference of the coil 1 wound on the mandrel 2 as indicated by the arrows. After the appropriate assembly or positioning of the cylinder segments in this manner they are preferably retained in place, at least temporarily, by suitably disposed clamping rings or the like (not shown) which may be circumferentially contracted to apply a desired and accurately controlled force to the sectors to thereby establish a uniformly distributed contact pressure between the inner surfaces of the segments and the coil.

With the segments 11 thus clamped in place their axially abutting edges or seams are permanently secured together by weld beads 12 as shown in FIG. 4. The cylinder sectors are typically made of aluminum, and to suitably insulate them from the coil windings the outer surface of the coil 1 is sheathed with an electrical insulation layer 14 such as glass fiber reinforced epoxy resin, overlapped Kapton tape or the like. The individual conductor turns are also, of course, appropriately insulated from each other in a similar and conventional manner. In order to protect such insulation from thermal damage due to the localized heat generated during the seam weldings, the inner surfaces of the sectors 11 are preferably formed with complementary recesses 15 at the axial edges of the sectors, and heat shielding strips 13 of laminated glass epoxy or the like are then inserted into the spaces jointly defined by the recesses to establish heat transfer barriers/reflectors. The inner winding mandrel 2 is, of course, removed after all of the weld beads 12 have been completed, as described above.

In the modification illustrated in FIG. 5 the support cylinder sectors 11 are formed with axially extending passages 22 at least proximate the weld seams between adjacent sectors, and cooling water is pumped through such passages during the formation of the weld beads 12 to further dissipate the heat generated during the welding process. FIG. 6 illustrates temperature versus time curves plotted from measurements taken at points A and B in FIG. 5 during the formation of the weld bead 12. As may easily be seen, the maximum temperature rise at the end of the recess 15 (point B) is on the order of 80° C. and its duration is only several seconds, while the corresponding temperature rise at the outer surface of the insulation layer proximate the recess (point A) is on the order of 50° for a like period of time. Such temperature magnitudes and durations are well within the tolerance limits of the insulation layer 14 and do not result in any thermal degradation.

FIG. 7 illustrates an alternate construction wherein the support cylinder sectors 11 are provided with outwardly projecting radial flanges 30, and the sectors are assembled together by bolts 31 rather than by welding. With such a construction the recesses 15 and the heat shielding strips 13 may, of course, be dispensed with. This embodiment offers the further advantage that the radial compressive force applied against the coil 1 by the support cylinder sectors may be precisely and accurately controlled by the appropriate adjustment of the bolts 31.

What is claimed is:

1. A large diameter, high amperage bobbinless solenoid coil, comprising:

(a) a cylindrically wound conductor coil (1), (b) a plurality of support cylinder sectors (11) assembled to define a support cylinder having an equal plurality of axial seam lines and disposed surrounding the coil and in intimate heat transfer contact therewith, and (c) means for rigidly joining the assembled support cylinder sectors together along the seam lines, whereby the support cylinder absorbs and dissipates heat generated by the high amperage current flowing through the conductor coil and withstands the radially outwardly directed electromagnetic forces generated during the operation of the coil.

2. A solenoid coil according to claim 1, wherein the cylinder sectors are aluminum, and the joining means comprises weld beads (12) disposed along the seam lines.

3. A solenoid coil according to claim 2, wherein inner surfaces of the cylinder sectors adjacent the seam lines are formed with complementary recesses (15), and heat shielding strips (13) of laminated glass epoxy are disposed in the recesses to protect insulation (14) on the coil from thermal damage during the formation of the weld beads.

4. A solenoid coil according to claim 3, wherein axial passages (22) are formed in the cylinder sectors adjacent the seam lines to accommodate a flow of cooling water during welding.

5. A solenoid coil according to claim 1, wherein the joining means comprises outwardly projecting radial flanges (30) on the support cylinder sectors along the seam lines, and a plurality of bolts (31) extending through adjacent flanges.

6. A method of manufacturing a large diameter, high amperage, bobbinless solenoid coil, comprising the ordered steps of:

(a) winding a conductor coil (1) around a cylindrical inner mandrel (2), (b) assembling a plurality of support cylinder sectors (11) to define a support cylinder having an equal plurality of axial seam lines and disposed surrounding the coil and in intimate heat transfer contact therewith, (c) rigidly joining the assembled support cylinder sectors together along the seam lines, whereby the support cylinder absorbs and dissipates heat generated by the high amperage current flowing through the conductor coil and withstands the radially outwardly directed electromagnetic forces generated during the operation of the coil, and (d) removing the inner mandrel.

7. A method according to claim 6, wherein the rigid joining comprises the formation of weld beads (12) along the seam lines.

8. A method according to claim 7, further comprising:

(a) forming complementary recesses (15) in inner surfaces of the cylinder sectors adjacent the seam lines, and (b) disposing heat shielding strips (13) in the recesses to protect insulation (14) on the coil from thermal damage during the formation of the weld beads.

* * * * *